United States Patent [19]

Kanazawa

[11] 3,948,508

[45] Apr. 6, 1976

[54] SHEET DELIVERY APPARATUS

[75] Inventor: Yukio Kanazawa, Ebina, Japan

[73] Assignee: Rank Xerox Ltd., London, England

[22] Filed: Nov. 11, 1974

[21] Appl. No.: 522,397

[30] Foreign Application Priority Data

Dec. 24, 1973 Japan ..... 48-146926[U]

[52] U.S. Cl. ..... 271/206; 198/180

[51] Int. Cl.[2] ..... B65H 29/02

[58] Field of Search ..... 271/9, 203, 204, 206, 277; 198/180

[56] References Cited

UNITED STATES PATENTS

| | | | |
|---|---|---|---|
| 1,879,095 | 9/1932 | Claybourn | 271/206 |
| 2,625,394 | 1/1953 | Brown | 271/204 |
| 3,266,796 | 8/1966 | Haney et al. | 271/206 |
| 3,275,318 | 9/1966 | Lavander | 198/180 |
| 3,610,579 | 10/1971 | Jiruse | 271/206 |
| 3,698,706 | 10/1972 | Mihojevich et al. | 271/9 |
| 3,713,648 | 1/1973 | Spika | 198/180 |
| 3,797,929 | 3/1974 | Deacon et al. | 271/204 |

*Primary Examiner*—John J. Love
*Assistant Examiner*—Robert Saifer

[57] ABSTRACT

A chain delivery sheet feeding device, including a sheet size selector switch for selecting a desired sheet size among paper sheets of different sizes which are separately carried on a plural number of paper trays located within the apparatus. A plurality of grippers are provided on chain members for gripping the paper sheets. A sheet releasing device is also provided for separating the paper sheets from the grippers. The sheet releasing device comprises a switching member having a movable gripper-releasing cam member which is adapted to operate under the control of a solenoid device which determines the sheet releasing point for the grippers. A size selector switch and the sheet releasing point determining solenoid device are opreated in relation to each other by means of a delay circuit in such a manner that a current sheet releasing point is retained until the last one of a number of copy sheets for a preceeding original size is released.

1 Claim, 9 Drawing Figures

FIG. 5
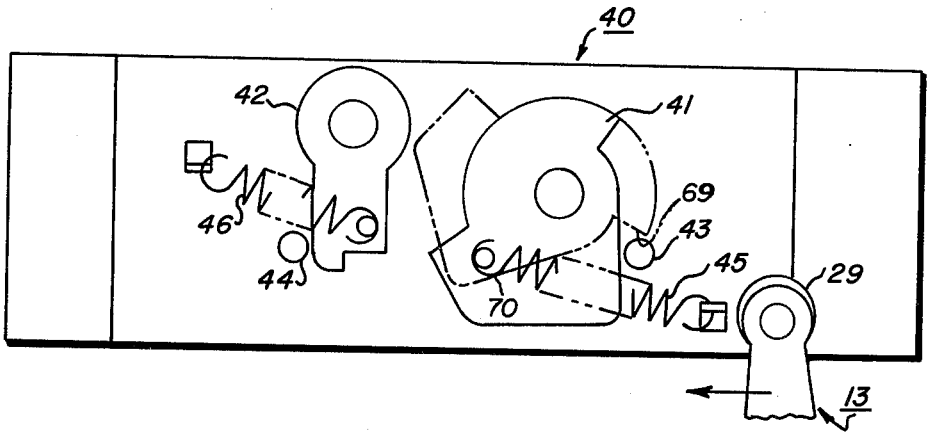
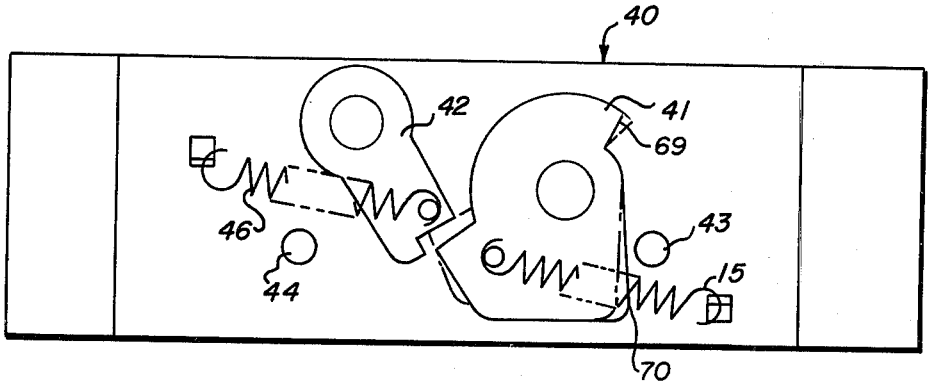
FIG. 6

SHEET DELIVERY APPARATUS

BACKGROUND OF THE INVENTION

This invention relates to a chain delivery type sheet feeding apparatus, and more particularly to a chain delivery type sheet feeding apparatus suitable for use in duplicator machines, printing machines, or the like. The sheet feeding apparatus is adapted to allow selection of a copy paper sheet or sheets of a desired size simply by operation of an external switch. The copy sheets for selection are of a number of different sizes and each different size is separately held on an associated paper tray located within the apparatus.

With sheet feeding apparatus of the above type, it has been the usual practice to provide a gripper or grippers adapted to release a paper sheet at a predetermined point irrespective of the paper size and to thereby align the foreend edges of the sheets at the same predetermined point.

However, this may impose some undesirable limitations on the design of a duplicator machine employing such a sheet feeding arrangement and it is sometimes therefore desirable to align the rear-end edges of the copy paper sheets.

SUMMARY AND OBJECTS OF THE INVENTION

The present invention has as its object the provision of a chain delivery type sheet feeding apparatus which eliminates the aforementioned limitation and which allows alignment of any desired end of paper sheets of different sizes. The sheet feeding apparatus of the invention is characterized by the provision of a solenoid device which operates in association with a sheet size selector switch for changing the operating conditions of a gripper releasing cam member to thereby change the sheet releasing point of the gripper according to the selected size of the paper sheet, so that paper sheets of different sizes may be aligned at their rear end edges, if desired.

According to the present invention, a chain delivery arrangement is provided having more than two grippers on the delivery chain and is especially adapted for use with feeding arrangements for delivering paper sheets of different sizes. The paper sheet held in the grippers is released at a predetermined position allocated to the particular size of the gripped sheet and aligned at the rear end thereof, irrespective of the fact that the selector switch for a different sheet size is pressed during the delivery operation of the preceeding paper sheet.

BRIEF DESCRIPTION OF THE DRAWINGS

FIGS. 5 and 6 are illustrative views showing the operation of the sheet releasing device;

DESCRIPTION OF THE PREFERRED EMBODIMENT

The particular embodiment of the present invention will now be described with reference to the accompanying drawings.

Figure 1:
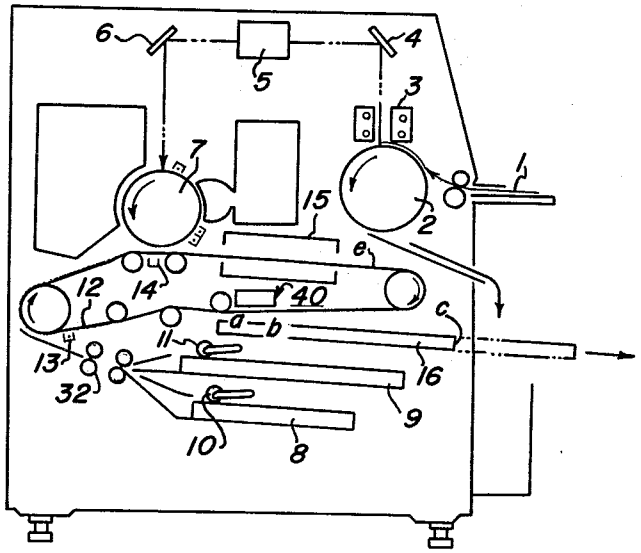
FIG. 1 is a diagrammatic view showing the general construction of electrophotographic duplicator machine employing the present invention.

Referring first to FIG. 1 showing an electrophotographic duplicator machine employing the present invention, an original document is fed through an original inlet 1 and wound around a document drum 2 for exposure to light rays from a light source 3. The reflected light rays from the original are directed onto a photoconductive drum 7 via the optical elements 4, 5 and 6. A latent image is formed on the photoconductive drum 7 by a conventional electrophotographic method, for example, by the xerographic method. The latent image formed on the photoconductive drum 7 is rotated through the conventional xerographic process stations including a development station at which a powder image is formed on the drum 7. Subsequent rotation of the drum 7 brings this powder image to a transfer station 14, at which the powder image is transferred to a copy paper sheet which is fed from paper trays 8 or 9.

The copy sheets are moved from the trays 8 or 9 into the area adjacent the drum 7 by means of feed rollers 10 or 11 and a gripper 13 which is mounted on the chain 12. Thereafter, the paper sheet is passed through a fixing device 15 which renders the powder image permanent. The copy sheet is then discharged into a receptacle tray 16.

Figure 2:
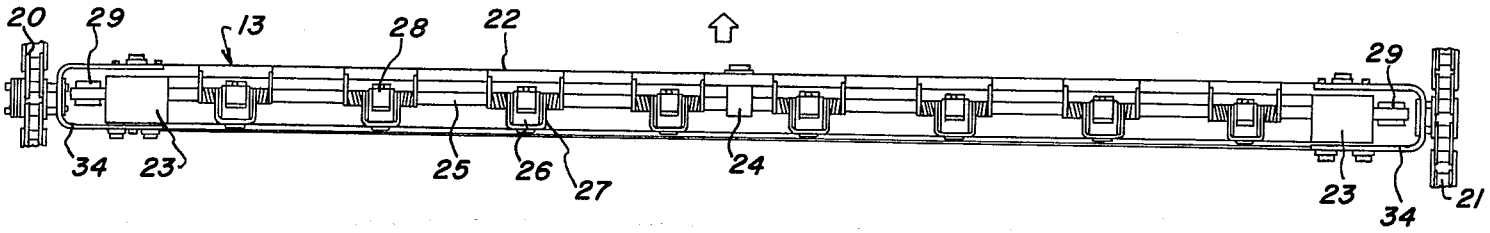
FIG. 2 is a plan view of a gripper.
Figure 3:
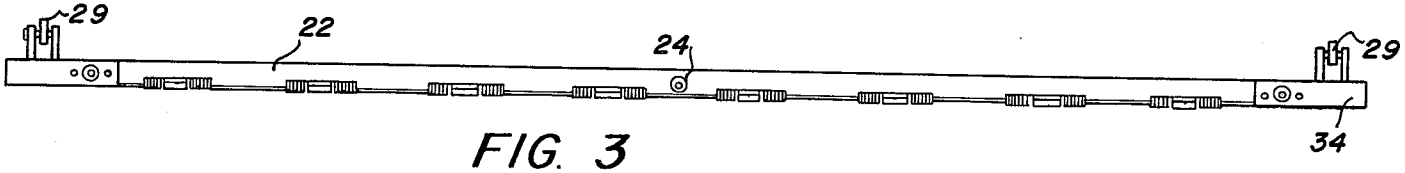
FIG. 3 is a front view of the gripper.
Figure 4:
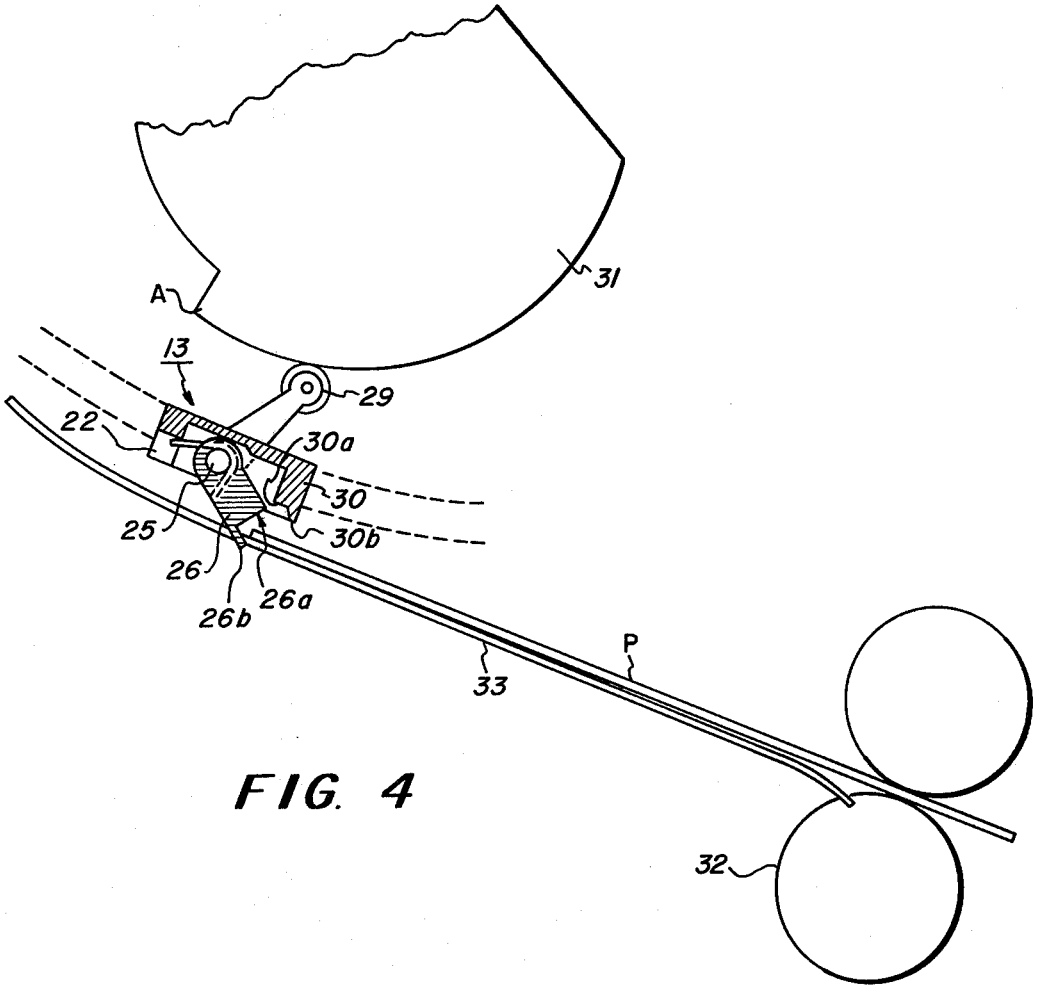
FIG. 4 is a view showing the operation by the gripper.

The aforementioned gripper 13 is attached at opposite ends thereof to two parallel chains 20 and 21 by means of brackets 34, as shown particularly in FIGS. 2 to 4.

More particularly, a shaft 25 is rotatably supported within a gripper bar 22 of U-shaped cross-section by means of bearings 23 and 24. The shaft 25 supports at suitable intervals along the length thereof, a plural number of rotatable gripper members 26. The gripper members 26 are each provided with a stopper member **26*a* for aligning the fore ends of the paper sheets P and with a gripping portion 26*b* for pressing the paper sheet against one end of the gripper bar 22 to hold it in place. The gripper members 26 are constantly biased in a gripping direction by means of spring 27 which is mounted on associated shafts 25.**

A cam block 28 is fixedly mounted on the shaft 25 within each gripper member 26 and rotates with the shaft 25 to pivot the gripper member 26 upwardly, as seen in FIG. 4, to receive and release the paper sheet P. The shaft 25 is rotated counterclockwise, as seen in FIG. 4, and the rotation of the shaft 25 is accomplished, for example, by actuating levers 29 fixedly attached to opposite ends of the shaft 25 which levers 29 are operated by a cam 31.

One end 30 of the U-shaped gripper bar 22 is formed with two steps **30*a* and 30*b* (see FIG. 4) and the gripper member 26 holds a paper sheet P in cooperation with an inner lower step 30*a* of the gripper bar. When the paper sheet P is gripped, it is projected outwardly by means of the upper step 30*b* of the two-stepped gripper bar end to ensure that the fore end of the paper sheet P is tightly wound around the photoconductive drum 7 at the copying position 14.**

In order to grip the paper sheet P, the gripper members 26 are opened and closed by rotating levers 29 by means of the cam member 31, as shown in FIG. 4. More particularly, when the paper sheet P is fed along a guide member 33 by means of the feed rollers 32, the gripper 13 which moves at a slower speed than the paper sheet P aligns the fore end of the paper sheet P at the stopper 26*a*. When the lever 29 rides over the point A on the cam 31, FIG. 4, the gripper member 26 is closed, by the biasing action of spring 27 to grip the paper sheet P.

FIGS. 5 and 6 show a paper sheet releasing device 40 (the general location of which in the machine is shown in FIG. 1), which comprises a moving cam member 41, a switching member 42, which is adapted to operate in association with a sheet size selector switch by means of a solenoid device (not shown), stopper members 43 and 44, and spring members 45 and 46 which cooperate with the cam member 41 and switching member 42, respectively.

Referring to FIG. 5 which illustrated the operation in which a larger paper sheet size is selected, the solenoid device (not shown) is de-energized and the switching member 42 is held in a stand-by position against the stopper member 44 by the action of the spring 46. After the copy is fixed, the copy sheet moves toward the sheet releasing device 40 and the levers 29 of the gripper 13 are brought into abutment against the movable cam 41. As the gripper 13 advances in the direction of the arrow (FIG. 5), the movable cam 41 is rotated clockwise against the action of the spring 45 until its movement is limited by abutment between the surface 69 and the stopper 43, as indicated in broken lines in FIG. 5. When the rotation of the movable cam member 41 is thus blocked by the stopper 43 the levers 29 of the gripper 13 are rotated or pivoted clockwise by the camming action of surface 70 of the cam member 41. The clockwise rotation of levers 29 is transmitted to the gripper member 26, FIG. 4, resulting in the release of the paper sheet, the point at which the sheet is released by the gripper 13 being indicated generally at *a* in FIG. 1.

In order to alter the paper size from a larger one to a smaller one, a solenoid device, which will be described hereinafter, is energized by actuation of a paper size selector switch, which is located for manual operation on an exterior panel of the duplicator machine, and an automatic paper size detector switch, thereby moving the switching member 42 against the action of the spring 46 to the changeover position shown in FIG. 6. When the gripper 13 passes during the sheet releasing device 40 in the condition of FIG. 6, rotation of the movable cam member 41 is blocked by the switching member 42. In this case, the levers 29 make contact with the surface 70 at a time much earlier in the cycle and are again rotated clockwise to cause release of the paper. However, the paper releasing point in this instance is generally indicated at *b* in FIG. 1.

It is thus seen that in this manner the rear edges of both the smaller and larger sheets are aligned at the end C of the receptacle tray 16.

In the operation described above, the actuation of the solenoid device, i.e., the switching between the two sheets releasing points *a* and *b* is effected via actuation of a paper size selector switch. However, where only one gripper is provided on the chain, it may suffice to provide a "READY" lamp which is lit as soon as the last one of a required number of a paper sheet of a previously selected size has been completely released to indicate that the selection of another paper size is ready. However, where more than two grippers are provided on the chains in order to increase the copying speed, the provision of a plural number of grippers becomes meaningless if the "READY" lamp is not lit until the last one of the required number of the paper sheets is completely released.

In order to eliminate this defect, in the present invention, the "READY" lamp is lit at the time when the last one of the required number of paper sheets arrives at the point *c* of FIG. 1, i.e., when the machine is ready to accept a succeeding original. Thus, while allowing selection of a different paper size for a succeeding original as well as insertion of the succeeding original into the machine, the change-over of the sheet releasing point from *a* or *b* is delayed by the delay circuit until the last copy paper sheet for the preceeding original is released to prevent undesirable premature switching of the sheet releasing position due to the preselection of a different paper size.

Alternatively, where an automatic original size detector is provided, the time for lighting the "READY" lamp may be determined in accordance with the position of the original, instead of in relation with the position of the copying paper.

The following description is directed to the associated operation of the automatic and manual sheet selector switch and the solenoid device, with paper sheets of two different sizes for simplicity of explanation.

Figure 7:
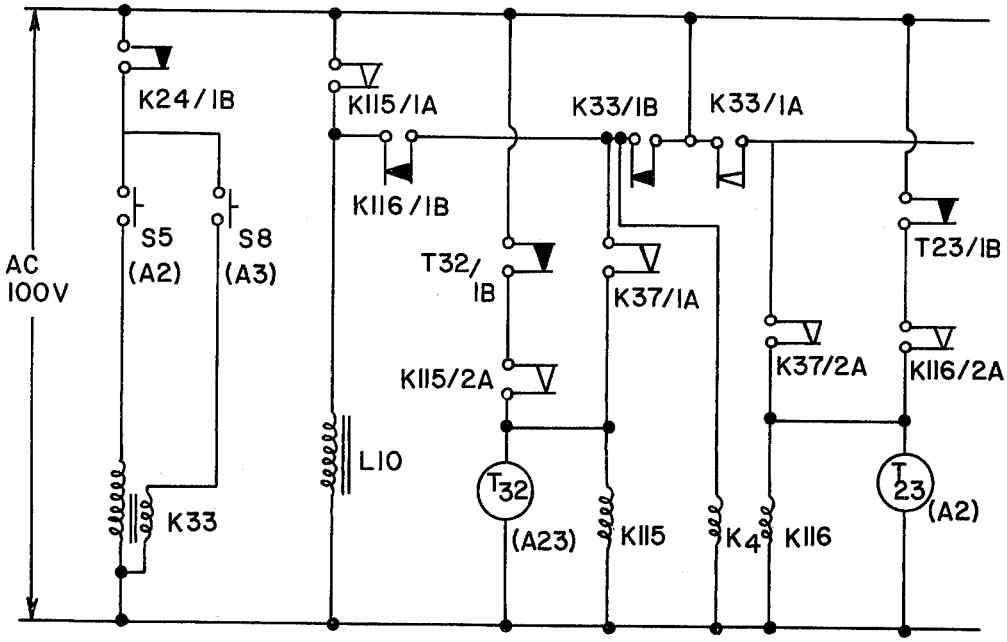
FIGS. 7 and 8 are electrical circuit diagrams showing a control arrangement for the sheet feeding device of the invention.

In FIG. 7, two sheet selector switches are shown at S5 and S8, of which S5 is for paper sheets of the size A2, and S8 is for the paper sheets of the size A3. The circuit shown in FIG. 7 is suitable for manual selecting operation.

When the sheet selector switch S5 for the size A2 is actuated, a "keep" relay K33 is energized to switch the contactd K33/1B and K33/1A to the positions reverse to those shown in FIG. 7, such that contacts K33/1B are open and contacts K33/1A are closed. In this manner, the relay K4 is not energized and consequently contacts K4/1B and K4/1A are in the conditions shown in FIG. 8. With K4/1B closed the indicator lamp LA-1 for the sheet size A2 is lit and the lamp LA-2 is not lit. The solenoid L10 is maintained in an unactivated condition by the de-energized relay K115 which keeps contacts K115/1A open.

With commencement of the duplicating cycle, the relay contacts K24/1B of a relay (not shown) which is actuated upon detection of an original as, for example, by the closing of a microswitch, are opened and thereby prevent a change of the selected sheet size during the duplication cycle. Upon completion of the duplication cycles for a selected number of copies, contacts K37/2A of another relay (not shown) which is actuated in response to a signal are closed instantaneously by pulse operation. This is the time at which the signal indicative of the completion of one duplicating cycle coincides with a signal indicating that the last one of a selected number of paper sheets has arrived at point *d* of FIG. 1. Concurrent with the closing of contacts K37/2A, contacts K24/2B (see FIG. 8) and contacts K24/1B are closed. With contacts K24/2B closed, the "READY" lamp is lit to indicate that the machine is ready for selection of a different sheet size and insertion of a next original.

Concurrently, also with the closing of K37/2A, relay K116 is energized to complete its contacts K116/2A and start a relay timer T23. The other contacts K116/1B of the relay K116 are broken. These contacts are held in a broken state until contact T23/1B of the timer T23 is broken, after lapse of a predetermined time period. Thus, the solenoid L10 is maintained unenergized even if the A3 sheet size selector switch S8 is actuated during the above mentioned time period, with the cam member 41 held in the position shown in FIG. 5.

If the A3 sheet size selector switch S8 is depressed to start a duplication process on paper sheet or sheets of the size A3, the contacts K33/1B and K33/1A of the keep relay K33 are brought into the positions as shown in FIG. 7, such that the contacts K33/1B are closed and the other contacts K33/1A opened. Meanwhile, the contacts T23/1B of the relay timer T23 are broken to de-energize the closing relay K115 and, simultaneously with closing of the contacts K116/1B of the relay K116, the solenoid L10 is energized to switch the cam 41 into the position shown in FIG. 6.

Conversely, when the sheet size A3 is first used and then the A2 size is selected, *s* relay timer T32 is acuted instead of the timer T23 and energization of the solenoid L10 is maintained by a pulse operation of the contacts K37/1A, instead of the contacts K37/2A, until the contacts T23/1B of the timer T23 are broken. If the sheet size selector switch S5 for the size A2 is depressed upon breaking the contact T23/1B, or before a paper sheet of the size A3 is released from the gripper, the contacts K33/1B are open and the relay K115 is maintained unenergized to break the contacts K115/1A to de-energize the solenoid L10. Thus, the cam member 41 is brought into the position shown in FIG. 5.

Figure 9:
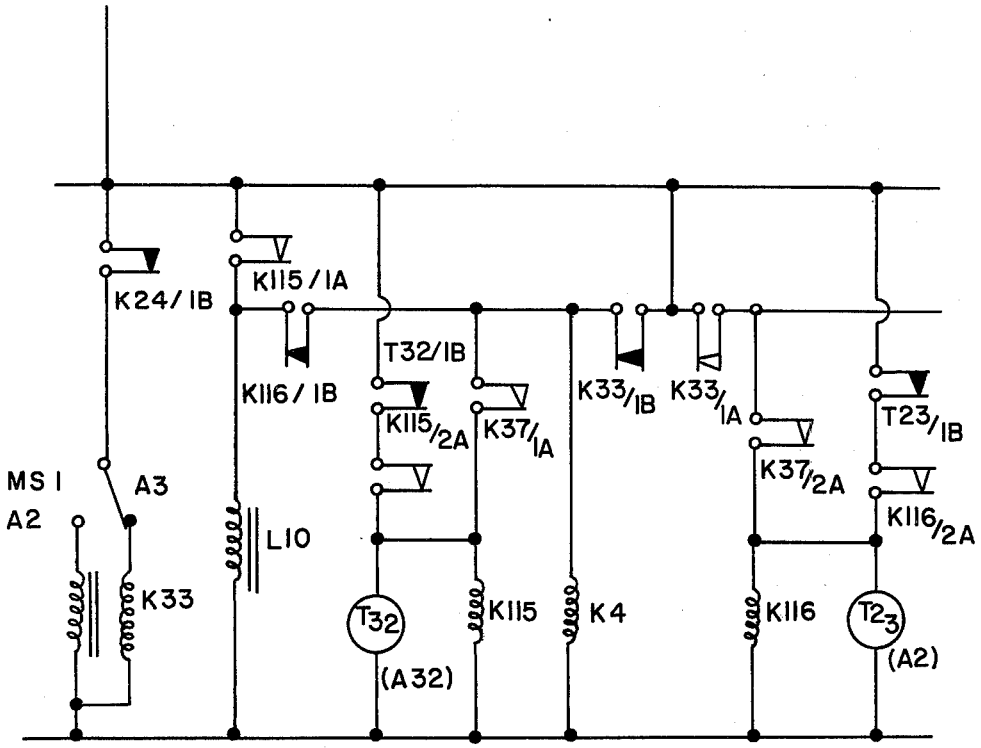
FIG. 9 is an electrical circuit diagram showing an alternative control arrangement.

FIG. 9 shows a circuit arrangement wherein a microswitch MS1 is employed in place of the sheet size selector switches S5 and S8 of FIG. 7. The microswitch MS1 is mounted in the vicinity of the original inlet and is not actuated when the size of the original is A3, normally closing the contact for the size A3 as shown in FIG. 9. This places the duplicator machine in the same conditions as when the A3 size selector switch S8 is actuated in FIG. 7. With an original of the size A2, the microswitch is changed over to complete the contact for the size A2. This is the same as when the A2 size selector switch S5 is depressed in FIG. 7.

Figure 8:
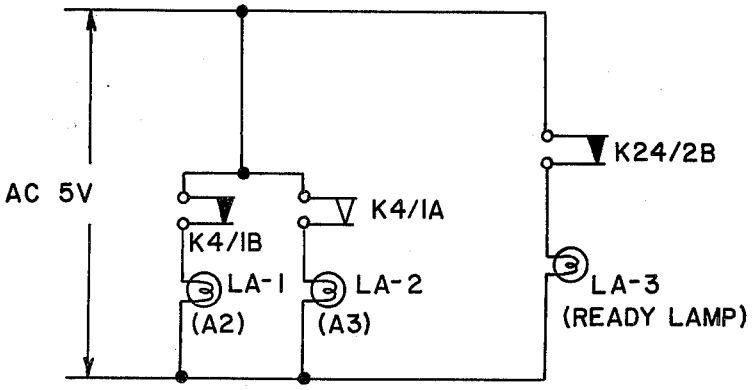

However, since the selected sheet size and the sheet releasing point may be present simply by inserting an original, it suffices to break the contact K24/1B for a minimum period of time, for example, for a time period necessary for winding the original on the document drum, completing the same together with the contact K24/2B, FIG. 8, which lights the "READY" lamp. A succeeding original is inserted immediately after a preceeding original and the inserted succeeding original is fed automatically as soon as a duplication cycle for the preceeding original is completed.

As described hereinbefore with reference to FIG. 7, the solenoid is switched over after release of the copying paper sheet for the preceeding original. Thus, the duplication speed may be increased significantly in an effective manner.

The chain delivery type sheet feeding device according to the invention increases the duplication speed significantly eliminates the possibility of a fire due to the premature release of a paper sheet of a larger size of a smaller size which has been left within the duplicator machine without being discharged onto the receptacle tray.

What is claimed is:

1. A sheet delivery arrangement comprising:

a plurality of paper storage trays for holding different sized copy sheets, a pair of endless chains, a plurality of gripper bars attached between said claims and extending generally at right angles to the longitudinal dimension of said chains, said bars having a generally U-shaped cross-section to define a channel, a shaft supported for rotation by each bar in said channel, a plurality of gripper fingers supported from said shaft, resilient means carried by said shaft for biasing said fingers toward one leg of said U, said one leg and said fingers when biased into contact with each other forming a gripper portion to hold sheets of paper in place, a lever arm coupled to said shaft, a rotatable release cam, spring means for urging said cam in a first direction, said lever arm operable to engage said cam and rotate it against the bias of said spring toward first and second positions, first and second surfaces for limiting the rotation of said cam, said first surface being stationary and operative to limit the rotation of said cam to said first position, said second surface mounted for rotation into and out of engagement with said cam, means operable in response to the selection of a first sized paper to rotate said second surface into contact with said cam to limit rotation of said cam to said second position, and operable in response to the selection of a second size of paper to move said second surface out of engagement with said cam to permit rotation of said cam beyond said first position into contact with said first surface to define said first position, whereby said cam is operative to cause release of said paper along a first line in said delivery trays when in said first position and along a second line when in said second position.

* * * * *